United States Patent [19]

Besnard

[11] Patent Number: 4,809,784

[45] Date of Patent: Mar. 7, 1989

[54] TOOL FOR UNDERWATER CONNECTIONS ON AN OIL PRODUCTION STATION

[75] Inventor: Francois Besnard, Lescar, France

[73] Assignee: Societe Nationale Elf Aquitaine (Production), Courbevoie, France

[21] Appl. No.: 154,658

[22] Filed: Feb. 10, 1988

[30] Foreign Application Priority Data

Feb. 17, 1987 [FR] France ..... 87 01985

[51] Int. Cl.[4] ..... E21B 43/01

[52] U.S. Cl. ..... 166/340; 166/341; 166/360

[58] Field of Search ..... 166/338, 339, 340, 341, 166/360, 365

[56] References Cited

U.S. PATENT DOCUMENTS

| | | | |
|---|---|---|---|
| 3,064,735 | 11/1962 | Bauer et al. | 166/339 X |
| 3,589,441 | 6/1971 | Brown et al. | 166/339 |
| 4,375,835 | 3/1983 | Archer | 166/339 |
| 4,452,312 | 6/1984 | Roblin | 166/339 |
| 4,611,661 | 9/1986 | Hed et al. | 166/339 |

*Primary Examiner*—Stephen J. Novosad

*Attorney, Agent, or Firm*—Poms, Smith, Lande & Rose

[57] ABSTRACT

Sphere of application: underwater oil production installations using electrical and hydraulic interconnections between the various assemblies of the underwater station such as well heads, control modules, manifolds and the like.

A remote-controlled multiconnector-pod assembly 1*a*, 1*b* is located on an underwater base on which is anchored a hollow tube 10 having an upper edge 10*a*.

A disconnectable tool is suspended at the support plate 20 and is provided by a connection jack 30 with a mechanical connector 40 designed to grip on to a mandrel 5 which is integral with the pod.

The tool is anchored by jacks 23 and 24 and holes 10*b*, while the pod is locked into the tube 10 by bolts 6 which extend into the holes 10*c* of the tube.

With this system it is possible to install the pod by remote control and then to raise the tool so as to prevent any danger of it being damaged by sea corrosion.

9 Claims, 2 Drawing Sheets

10a
24
10b
22
20
30
23
31
46
47
44
43
45
41
42
50
51
52
53
53a
6a
6
10c
4
5
40
10
27
21

TOOL FOR UNDERWATER CONNECTIONS ON AN OIL PRODUCTION STATION

BACKGROUND OF THE INVENTION

The present invention relates to the field of underwater oil production installations using multiple and varied, electrical and hydraulic interconnections between different sub-assemblies of the underwater station, such as well heads, control modules, manifolds and other units.

Remote-controlled tools have to be used with these interconnections, which are often located at great depths on the sea bed because of their environmental conditions.

When it is necessary to use several connectors because of the number of interconnections, these can be grouped on a single support and operated by a single mechanical-hydraulic system. A sub-assembly of this type comprising several connectors is described as a "multi-connector".

As a variant the multiconnector can be associated with a remote-controlled sub-assembly, which receives from the surface commands of electrical, hydraulic or other origin and is used as an interface for controlling the various sub-assemblies of the station. This remote controlled sub-assembly is commonly known as a remote-controlled "pod".

With this multiconnector associated with this remote-controlled pod the electrical and hydraulic connections between the pod itself, the other bottom sub-assemblies and the surface systems can be established.

According to the standard practices a multiconnector which may be associated with a remote-controlled pod is brought into position with the aid of mechanical-hydraulic actuating systems, which as they are incorporated in the sub-assemblies to be placed on the sea bed, cannot be brought back to the surface at the end of the operation, so that maintaining them at the bottom of the sea involves the danger of their being damaged by the environment.

The object of the present invention is a disconnectable installation tool on an underwater oil production station of a module comprising solely a multiconnector or one associated with a sub-assembly for the remote-control of the control units of the station and which is characterized in that the base of the station is equipped with a set of vertical translation guiding means which are capable of working in conjunction with corresponding contact means which are integral with the module, whereby the module comprises on the one hand a mandrel provided with the means for working in conjunction with the disconnectable gripping means of the tool and on the other hand locking means for the module on the guiding means and whereby the said tool is suspended at a support plate, which has at its periphery means for installing the plate on the upper end of the guiding assembly and means for anchoring the plate on the guiding means, whilst the tool carries on the one hand disconnectable gripping means for the mandrel and on the other means for actuating and disengaging the locking means for the module on the guiding means assembly.

The said vertical translation guiding means which are anchored on the base of the station can take on various forms. They may consist for example of components such as posts or rails extending from the base and rising to the level of the module and the tool and used as guiding slides or ramps, along which the module provided with special contact means such as rollers is guided in vertical translation.

According to the preferred version, these vertical translation guiding means comprise a hollow tube anchored to the sea bed and open at its upper end.

The means of anchoring the plate to the upper part of the tube may consist of three assemblies carried by the plate on its circular periphery and offset by 120°, whereby each assembly comprises a hydraulic jack and a locking finger operated in translation by the said jack, whilst in the vicinity of its opening, the tube is provided with anchoring holes designed to receive the said locking fingers.

The plate may carry one or several installation dampers terminating in the shape of a wedge so as to be supported in the notches formed on the circular edge of the tube opening.

With these indexing notches which are designed to receive the positioning wedges of the installation dampers of the plate a correct angular orientation of the jack-lock assemblies in relation to the holes formed in the tube can be achieved.

The disconnectable gripping means of the tool may consist of a connector comprising on the inside of a hollow body, cocking-type pieces formed by the flexible blades of a split ring fitted at their ends with pawls which penetrate a housing formed on the periphery of the mandrel, the said ring being integral with the disengaging blocks adjacent to the hydraulic jacks used for disengaging the connection.

The means of locking the module on the tube wall may consist of sliding bolts and holes formed in the tube wall in the positions corresponding to the location of the said bolts when the connector is connected on the mandrel.

The said sliding bolts may be operated by actuating and disengaging means carried by the body of the connector and consisting for preference of pusher-type hydraulic jacks, the pusher of which terminates in a fork or hook, of which the curved part is directed downwards and operates in conjunction with a shoulder or a stop of the sliding bolt in such a way that the return of the connector interrupts the interaction of the hook and lock and enables it to be released. The upper part of the connector may bear a connection jack supported on the support plate, whereby this jack applies a vertical thrust to the connector after the jack-lock assemblies carried by the support plate have been locked on the tube wall.

It is self-evident that other means of actuating or disengaging the locking and disengaging means apart from hydraulic jacks can be used advantageously.

Other special features of the invention will be found in the following description of an embodiment, which is given by way of a non-restrictive example and which is illustrated by the following drawings.

IN THE DRAWINGS

FIG. 1 shows a schematic view of an assembly with the remote-controlled pod installed on the sea bed by means of the tool and FIG. 2 shows a more detailed front view of the tool according to the invention after it has been positioned and before the connectors have been connected in the left hand part of the drawing and a sectional view after the connectors have been connected in the right- hand part of the drawing.

DETAILED DESCRIPTION OF THE DRAWINGS

Figure 1:
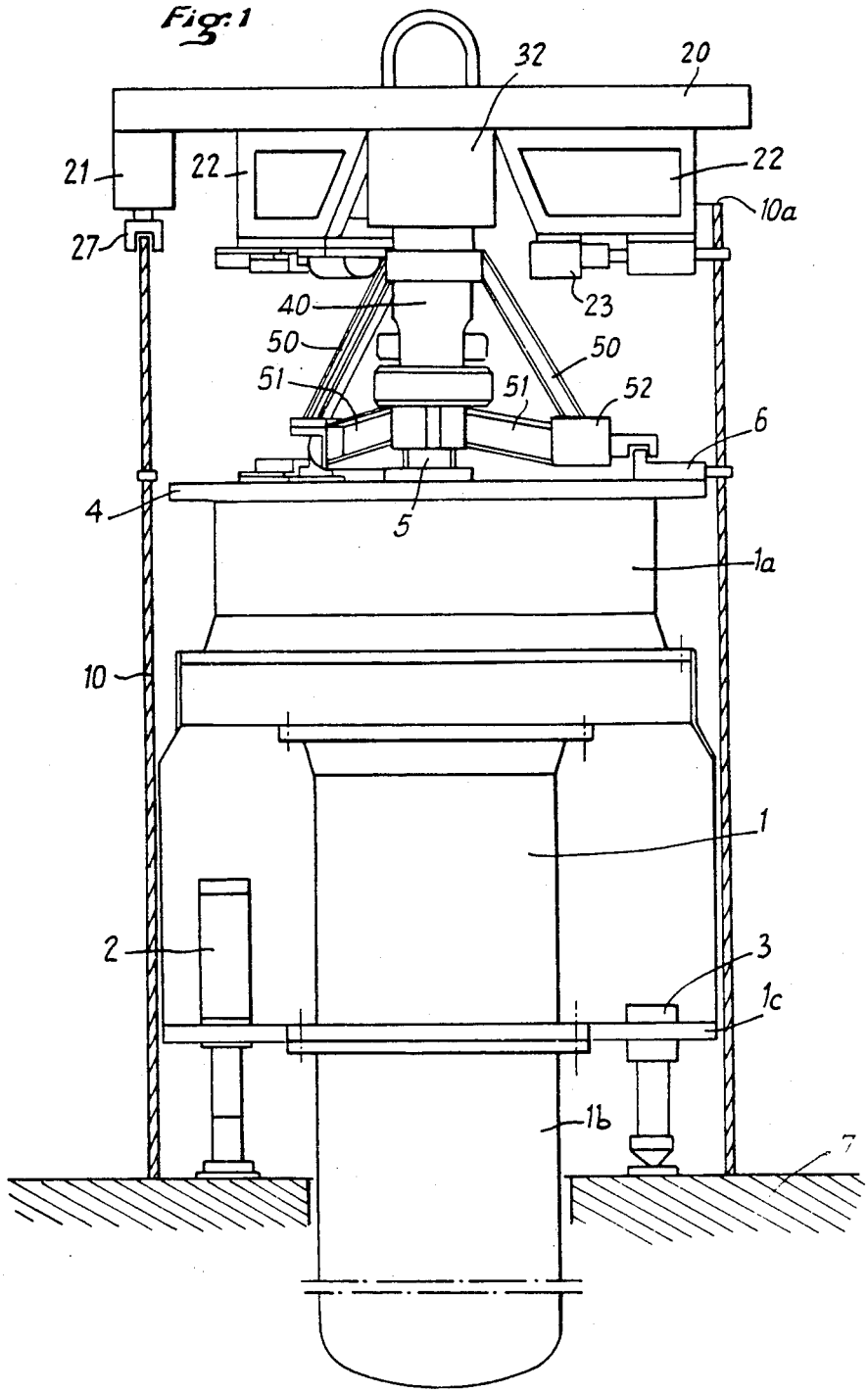

FIG. 1 shows the said assembly of the remote-controlled pod type in the form of a mushroom positioned on an underwater base by means of the disconnectable tool according to the invention.

This pod multiconnector assembly consists of a part 1*a*, which houses the hydraulic equipment and of a part 1*b*, which houses the electronic equipment of the assembly.

The foot of the mushroom penetrates the structure of the sea bed so as to reduce the space occupied by the assembly vertically and to prevent the danger of the equipment getting caught during the various handling operations.

A plate 1*c* in the form of a crown is fixed in the section 1*b* which supports electrical connectors 2 and hydraulic connectors 3 arranged in a circle on the annular support.

The connectors formed by the male parts are connected to the internal components of the pod and are designed to provide the connection to the female reception units carried by the base which is integral with the bottom structure and which are connected either to the surface control installations or to the oil systems at the bottom.

A plate 4 is mounted on the upper part of the assembly, from the centre of which projects a mandrel 5. Three locking bolts 6 which slide in a sleeve arranged for this purpose are also fixed at the periphery of the said plate in an offset arrangement of a 120°. These bolts are located as near as possible to the tube, which will be described below and they are capable of locking the assembly, even if the upper part 1*a* of the pod has a reduced diameter in relation to that of the tube.

A hollow tube 10, the end opening of which has a circular edge 10*a*, is anchored to the underwater base.

This edge is provided with three indexing notches which are offset to each other by 120°, whilst the tube 10 is fitted at its upper part with three holes 10*b* for anchoring the tool and at its intermediate part with three holes 10*c* for locking the pod multiconnector assembly by means of sliding bolts 6. Both the holes 10*b* and the holes 10*c* are offset to each other by 120° and each pair of holes 10*b* and 10*c* is located on the same generatrix, one above the other.

The connection tool is suspended at a circular support plate 20 provided on its periphery with three installation dampers 21 provided with entry cones 27 designed to be housed in the indexing notches of the tube 10. The plate 20 carries with the aid of carrier structures 22, three assemblies which are offset to each other by 120° of hydraulic jacks 23 and locking fingers 24 of the "sash" type designed to anchor the tool to the tube 10 by penetrating the holes 10*b*.

A connection jack 30 fitted with a jack rod 31 is attached to the central part of the plate 20, whilst the body of a mechanical gripping connector 40 is attached to this rod, the connector being designed to operate in conjunction with the mandrel 5 fixed to the centre of the electro-hydraulic assembly. The rod 31 carries by means of the carrier structures 50 and 51 means for actuating and disengaging bolts 6 which are integral with the multiconnector pod assembly. These means, which are offset to each other by 120°, consist of jacks 52, the rod 53 of which is shaped into a fork 53*a*, the teeth of which, which are curved downwards are able to cover the stop 6*a* of the bolt 6, in such a way that the rising of the tool frees the bolt 6 from any contact with the rod 53 and enables the tool to be disengaged.

The mechanical gripping connector 40 is of standard manufacture, being marketed for example under the Vetco trade mark. As its main characteristics are described in A1 French Pat. No. 255528) a detailed description will not be given here. The connector 40 is provided on the inside of a hollow body with cocking-type pieces formed from the flexible blades 41 of a split ring 43, the said blades being fitted at their ends with pawls 42 which penetrate a housing formed on the periphery of the mandrel 5. The said ring 43 is integral with the disengaging blocks 44 adjacent to the hydraulic jacks 45 which are used for disengaging the mechanical connection. An interposed ring 46 is also used for connecting the rod 31 of the jack 30 to the body 47 of the mechanical connector 40.

The tool operates as follows:

The tube 10 is anchored on the base plate 7 covering the production site and bearing the female parts used as receiving parts for connectors 2 and 3 and the seats for the guide columns which are not shown and which are used as means of angular orientation.

The multiconnector-pod assembly which is carried by the installation tool by means of the mechanical connector 40 is lowered by means of a cable and directed in its descent by means of a handling assembly comprising motors and television cameras, such as those described for example in A2 (French Pat. No. 2555248).

After the multiconnector pod assembly has been introduced into the tube 10, a rotational movement is imposed on it by means of motors, which is required so that the dampers 21 and the entry cones 27 come to the indexing notches of the circular edge 10*a*.

With this angular orientation an alignment of the assembly can be achieved in such a way that the guide columns (not shown) are located in the corresponding seats of the base plate 7, the connectors 2 and 3 are arranged in relation to the receptacles placed on the said base plate 7 and the anchoring bolts 24 and locking bolts 6 are in relation to the holes 10*b* and 10*c* respectively, the width of which is sufficiently large to allow a certain angular deflection.

Figure 2:
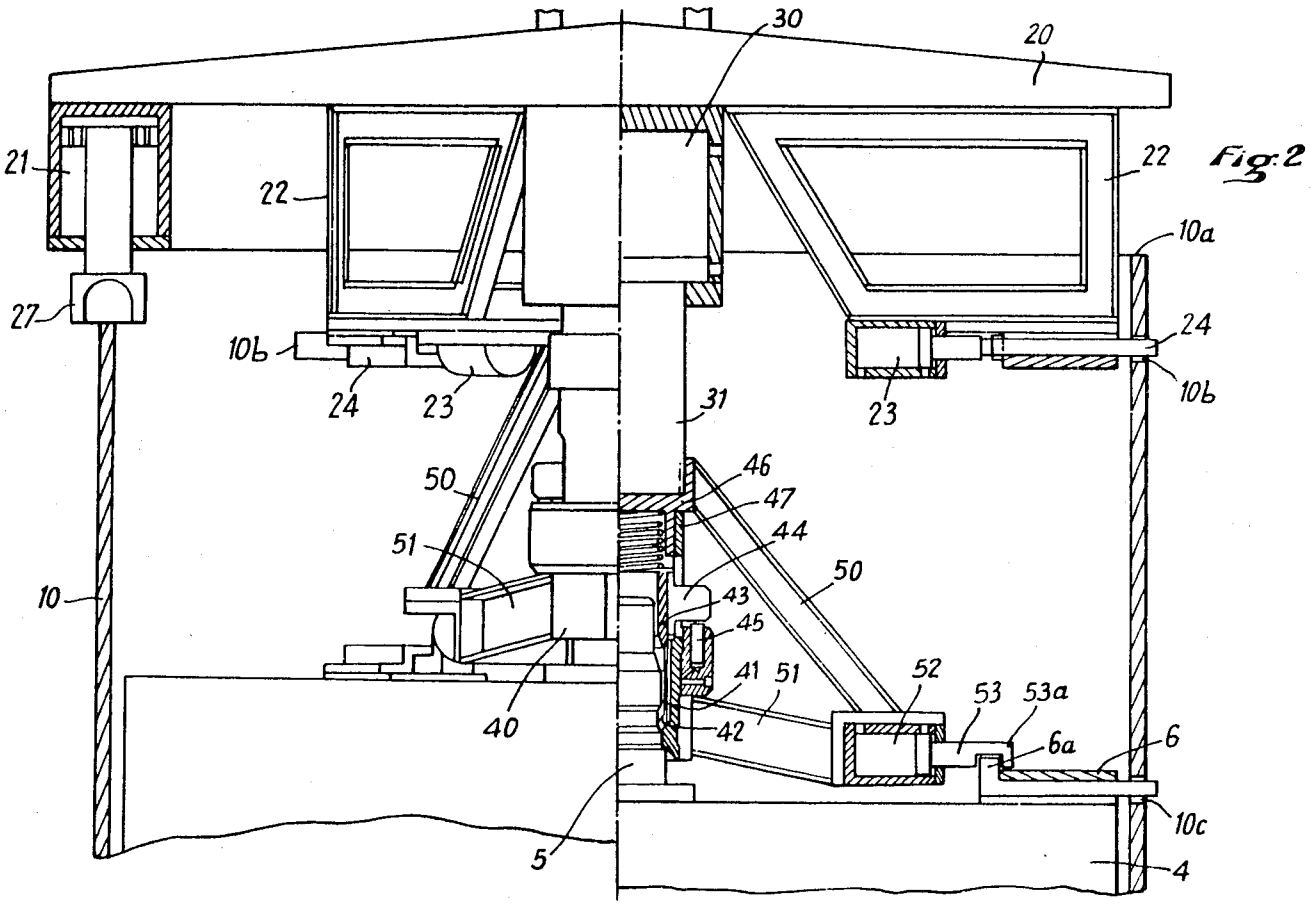

The anchoring jacks 23 are operated so that they make the bolts 24 penetrate the holes 10*b* (left-hand part of FIG. 2).

The connection jack 30 is operated so as to house the ends of the connectors 2 and 3 in their receptacles, after which the locking jacks 52 are operated so as to make the bolts 6 penetrate the holes 10*c*(right-hand part of FIG. 2).

To free the multiconnector-pod assembly from the tool and raise the tool the connector 40 is released by means of the jack 45 pushing back the ring 43, the tool is released from its anchorage by operating jacks 23 and raised.

Only the multiconnector-pod assembly remains inside tube 10 at the bottom of the sea.

The described assembly can also be replaced in the case of failure by another assembly with the tool according to the invention. For this purpose the operation for positioning the tool is carried out by making its support plate rest in the indexing notches of the tube and anchoring it by means of jack-bolt assemblies 23 and 24.

The connection jack 32, the rod 31 of which applies a thrust on the blades 41 of the ring 43, is operated in such a way that the mechanical connector 40 grips onto the mandrel 5.

The jacks 52 are operated to disengage the bolts 6 from their housings inside the holes 10*c*, after which the jacks 23 are operated so as to release the tool from its anchorage on the tube by disengaging the bolts 24 from the holes 10*b*.

By raising the tool connected to the multiconnector-pod assembly, the connectors are released from their receptacles.

Although the application example described relates to a multiconnector-pod assembly, the same tool can be applied to handling a plate which only carries connectors, provided that the said plate is provided in its central part with a mandrel and at its periphery with bolts so as to ensure that the plate is locked to the guide tube.

I claim:

1. Disconnectable installation tool on an underwater oil production station of a module (1) comprising solely a multi-connector or a multi-connector associated with a sub-assembly for the remote control of the control units of the station, comprising in combination said station having a base;

vertical translation guiding means (10) on said base of the station and suitable for operating in conjunction with corresponding means of contact on said module (1);

said module (1) comprising a mandrel (5);

disconnectable gripping means (40) on said tool cooperable with means on said mandrel;

means for locking (6) said module on the guiding means (10);

means for suspending said tool from said support plate (20) including means (21, 27) on the periphery of the support plate (20) for installing said plate on the upper end (10*a*) of said guiding means (10);

and means (23, 24) on the periphery of the support plate for anchoring said plate (20) on said guiding means (10);

said tool carrying said disconnectable gripping means (40) for said mandrel (5) and carrying means for actuating and disengaging (52, 53) said locking means (6) for the module (1) on said guiding means (10).

2. Tool according to claim 1, characterized in that said vertical translation guiding means (10) comprises a hollow tube (10) anchored to the sea bed and open at its upper end (10*a*).

3. A tool according to claim 2, characterized in that the means for anchoring the support plate (20) of the tool on the upper part of the guiding tube (10) comprises three jack-bolt assemblies, which are offset to each other by 120°, each assembly comprising a hydraulic jack (23) and a locking finger (24) actuated in translation by the said jack, said tube having anchoring holes (10*b*) in the vicinity of its opening designed to receive the said locking fingers.

4. Tool according to claim 3, characterized in that the support plate (20) carries one or several installation dampers (21), which terminate in the form of a wedge (27)

said circular edge (10*a*) of the upper opening of said tube being provided with notches for receiving and supporting said wedge (27).

5. Tool according to claim 4, characterized in that the circular edge (10*a*) of the upper opening of the tube is provided in predetermined positions with indexing notches designed to receive the positioning wedges of the installation dampers (21) of the plate in such a way as to effect a correct angular orientation of the jack-bolt assemblies 23, 24) in relation to the anchoring holes formed on the tube.

6. Tool according to claim 1, characterized in that the disconnectable gripping means of the tool comprise a connector (40) provided on the inside of a hollow body with cocking-type pieces formed by the flexible blades (41) of a split ring (43) provided at their ends with pawls (42) which penetrate a housing formed on the periphery of the mandrel (5), the said ring being integral with the disengaging blocks (44) adjacent to the hydraulic jacks (45) which are used for disengaging the connection.

7. Tool according to claim 6, characterized in that the means for locking the module on the tube wall are formed from sliding bolts (6) and holes (10*c*) formed in the tube wall in positions corresponding to the location of the said bolts when the connector is connected to the mandrel.

8. Tool according to claim 7 characterized in that the sliding bolt (6) is actuated by actuating and disengaging means carried by the connector body, the said means consisting of a pusher-type hydraulic jack (52), the said pusher (53) terminating in a fork or hook, the curved part of which is directed downwards and operates in conjunction with a shoulder or a stop (6*a*).

9. Tool according to claim 1, characterized in that the upper part of the connector is provided with a connection jack (30) supported on the support plate (20) of the tool, whereby the said jack (30 applies a vertical thrust to the connector (40), after the jack-bolt assemblies carried by the support plate have been locked on the tube wall.

* * * * *